United States Patent [19]

Pierce et al.

[11] Patent Number: 4,736,538

[45] Date of Patent: Apr. 12, 1988

[54] ARTICLE HOLDER AND DISPLAY DEVICE

[75] Inventors: Don C. Pierce; Emmagene S. Pierce, both of Port Clinton, Ohio

[73] Assignee: Huron Products Company, Bellevue, Ohio

[21] Appl. No.: 858,025

[22] Filed: May 1, 1986

[51] Int. Cl.[4] ..... G09F 1/12; G09F 1/10

[52] U.S. Cl. ..... 40/158 B; 40/152; 40/154; 40/156; 40/158 R

[58] Field of Search ..... 40/154, 155, 156, 157, 40/158 R, 158 B, 159, 152; 220/306, 324, 4 E; 292/302

[56] References Cited

U.S. PATENT DOCUMENTS

| | | | |
|---|---|---|---|
| 1,366,432 | 1/1921 | Summer | 40/156 |
| 2,118,384 | 5/1938 | Patten | 40/159 |
| 2,152,081 | 3/1939 | Nelson | 292/302 |
| 2,345,719 | 4/1944 | Weil, Jr. | 40/155 |
| 2,398,573 | 4/1946 | Becker | 220/324 |
| 2,631,631 | 3/1953 | Vogel | 220/324 |
| 3,024,899 | 3/1962 | Reitzel | 220/324 |
| 3,464,135 | 9/1969 | Eidinger | 40/159 |
| 3,710,761 | 1/1973 | Gregory | 220/4 E |
| 3,735,516 | 5/1973 | Wenstrom | 40/159 |
| 3,902,628 | 9/1975 | Schurman | 220/306 |
| 4,259,799 | 4/1981 | Fulton, Jr. | 40/159 |
| 4,477,991 | 10/1984 | Drevitch et al. | 40/152 |

FOREIGN PATENT DOCUMENTS

| | | | |
|---|---|---|---|
| 903038 | 2/1954 | Fed. Rep. of Germany | 40/158 B |
| 1243415 | 6/1967 | Fed. Rep. of Germany | 40/158 B |
| 3437027 | 4/1986 | Fed. Rep. of Germany | 40/158 B |
| 2485903 | 1/1982 | France | 40/154 |
| 2562406 | 10/1985 | France | 40/154 |
| 960447 | 6/1964 | United Kingdom | 40/158 R |
| 2092329 | 8/1982 | United Kingdom | 40/158 B |

*Primary Examiner*—Carl D. Friedman
*Assistant Examiner*—Michael Safavi
*Attorney, Agent, or Firm*—Marshall & Melhorn

[57] ABSTRACT

A device for retaining and displaying one or more photographs includes a pair of frames which are mirror images and are connected along one edge by a hinge. Each frame has an outer wall approximately equal in size and shape to the photograph and a plurality of side walls extending at an obtuse angle in the same direction from a periphery of the outer wall. The hinge permits the frames to be moved from an open position wherein the photograph can be inserted between the outer walls to a closed position wherein the photograph is retained between the outer walls. An opening in at least one of the outer walls permits the photograph to be displayed. An outer surface of each of the outer walls has a groove formed therein for retaining one end of a pair of legs attached to a base portion of a clip. The base portion of the clip can be placed on a generally horizontal surface and the legs will maintain the outer walls of the frames in a generally vertical position to display the photograph. Interior latch means can be provided to maintain the frames in the closed position.

1 Claim, 1 Drawing Sheet

ARTICLE HOLDER AND DISPLAY DEVICE

BACKGROUND OF THE INVENTION

The invention generally concerns a device for retaining and displaying articles and, in particular, a device for retaining and storing photographs whereby at least one of the photographs can also be displayed.

While there are many businesses concerned with the processing and printing of photographic film, the prints are generally delivered to the customer in the same manner. A paper envelope having one pocket for the prints and another pocket for the negatives is inserted inside an outer paper envelope which typically had been utilized to deliver the exposed film to the developer. When the customer receives the prints, he either places the prints in an album, or puts one or more prints in a picture frame for display, or leaves the prints in the envelope for storage.

If the prints are placed in an album, it is inconvenient to carry the album around in order to display the prints to others. If one or more prints are placed in a picture frame, they are separated from the rest of the prints which may be of the same subject matter and therefore desirable to keep together. If the prints are left in an envelope, each envelope must either be marked on the outside or opened separately in order to determine which envelope contains prints which are desired to be viewed.

SUMMARY OF THE INVENTION

The present invention concerns a combination holder and display device for articles such as photographic prints. A pair of cooperating frame-like retainers are connected together along one edge with a hinge to form a container for the articles. The retainers are similar to a picture frame in that the center section is cut away for viewing the articles retained between the two frames. The frames can be formed of a plastic material and the hinge can be a "living" hinge which is formed at the same time the frames are molded. The frames can be maintained in a closed position to retain the articles by cooperating latch pieces molded integral with the frames, or by a retaining clip which engages the outer surfaces of the frames. The retainer clip is generally triangular in cross section with one side forming a base and the other two sides forming a pair of legs for engaging grooves formed in the exterior surfaces of the frames. When the base side of the clip is placed on a horizonal surface, the clip supports the frames in a vertical position allowing the articles to be viewed through the opening in either one or both of the frames.

BRIEF DESCRIPTION OF THE DRAWINGS

The various features, advantages and other uses of this invention will become more apparent by referring to the following detailed description and drawings in which.

DESCRIPTION OF THE PREFERRED EMBODIMENT

Figure 1:
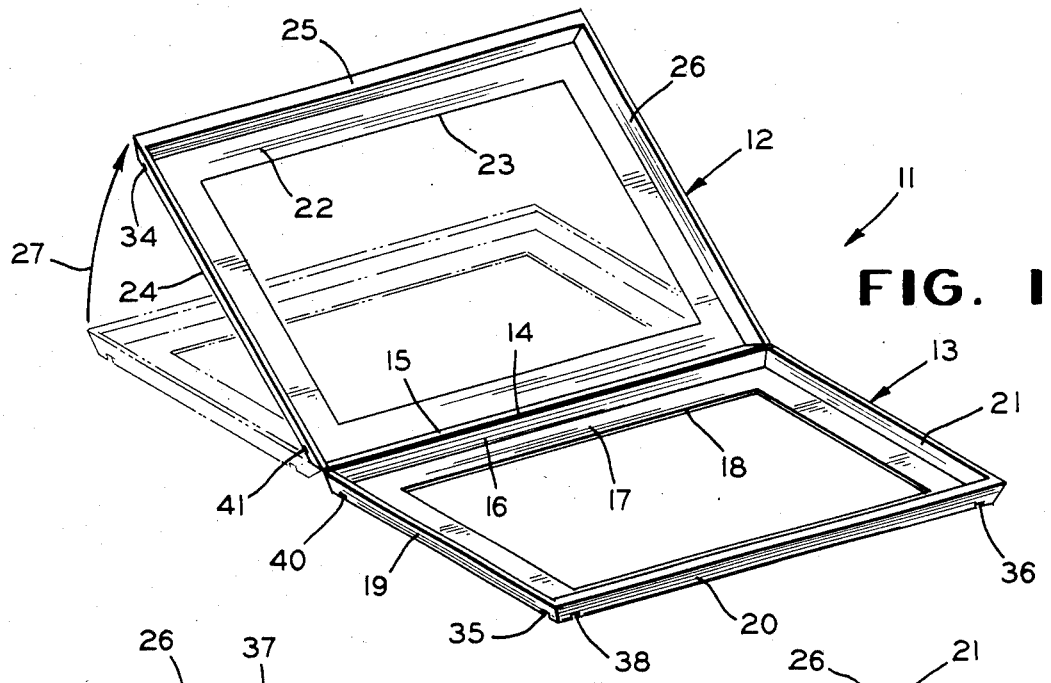
FIG. 1 is a perspective view of an article holder and display device according to the present invention showing the operation of a hinge.
Figure 2:
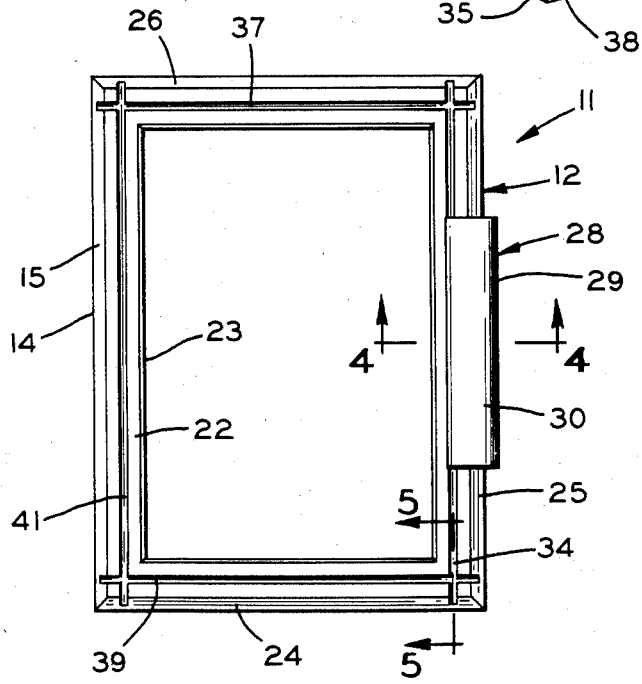
FIG. 2 is a front elevational view of the device shown in FIG. 1 in a closed position and including a retaining clip according to the present invention.
Figure 3:
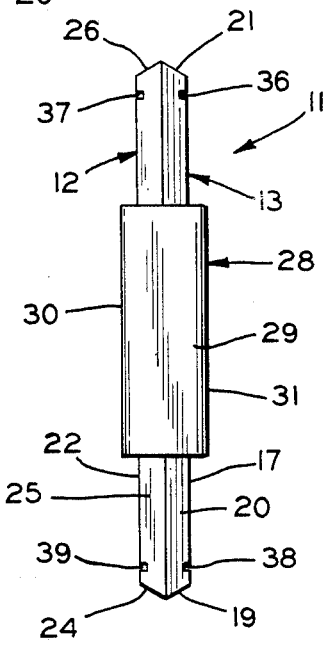
FIG. 3 is a right side elevational view of the device shown in FIG. 2.

There is shown in FIGS. 1 through 3, an article retainer and display device or container 11 having a first or front frame 12 and a second or rear frame 13. Although the frames 12 and 13 could be formed as separate items, it is preferable to mold them at the same time and connect them together with a hinge 14 along an outer edge of a side wall 15 of the frame 12 and an outer edge of a side wall 16 of the frame 13.

Preferably, the frames are made of a plastic material and the hinge 14 is a "living" hinge. Some of the plastic materials which can be utilized to form the container 11 include polypropylene, polyethylene and polystyrene. However, any suitable material can be utilized.

As shown in FIG. 1, the first side 16 is formed at an obtuse angle to a planar outer wall 17 defining a display face of the rear frame 13. The outer wall 17 has a generally rectangular central opening 18 formed therein. The edges of the outer wall 17 are connected to the side wall 16 and side walls 19, 20, and 21. The side walls 16 through 21 are connected together at their ends to enclose the periphery of the outer wall 17. Each of the sides 16, 19, 20 and 21 extends from the planar surface 17 at an obtuse angle away from the rectangular opening 18.

The first or front frame 12 is formed in a similar manner with an outer wall 22 having a generally rectangular opening 23 formed therein. The side 15 and sides 24, 25 and 26 enclose the outer periphery of the planar surface 22 and, like the sides connected to the planar surface 17, extend at an obtuse angle away from the rectangular opening 23.

Typically, the frames 12 and 13 and the hinge 14 are molded in the position shown in FIG. 1 where the frame 12 is outlined in phantom. The frames 12 and 13 are rotated about the hinge 14 to bring the sides 20 and 25 together as illustrated in FIG. 3. The arrow 27 in FIG. 1 demonstrates the movement of the frame 12 from the open position shown in phantom to the partially closed position shown in solid lines.

Figure 4:
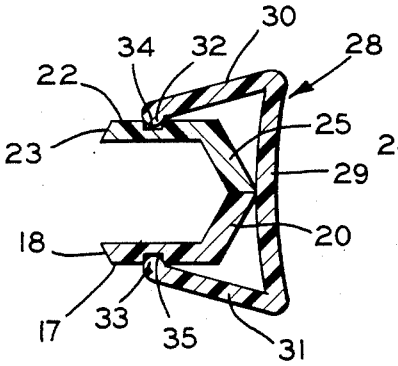
FIG. 4 is a cross-sectional view of the device shown in FIG. 2 taken along the line 4—4 and enlarged.

Once the two frames 12 and 13 have been closed, they can be retained in the closed position by any suitable latching means. For example, as shown in FIGS. 2 through 4, a clip 28 engages the outer surfaces of the outer walls 17 and 22 to retain the frames 12 and 13 in the closed position. The clip 28 includes a base portion 29 generally rectangular in form with a pair of legs 30 and 31 attached to and extending from the longer sides of the base portion 29. The legs 30 and 31 are formed at acute angles with respect to the base portion and are angled toward one another. The edge of the leg 30 opposite the edge attached to the base portion 29 has an inwardly facing lip 32 formed thereon which is generally semi-circular in cross-section as shown in FIG. 4. Similarly, the leg 31 has a semi-circular inwardly facing lip 33 formed along the edge opposite the edge which is attached to the base portion 29.

As shown in FIGS. 2 and 4, the outer surface of the outer wall 22 has an outwardly facing groove 34 formed therein extending substantially parallel to the side 25.

Similarly, the outer surface of the outer wall 17 has an outwardly facing groove 35 formed therein which extends substantially parallel to the side 20. The clip 28 is formed such that the distance between the lips 32 and 33 is less than the distance between the bottoms of the grooves 34 and 35. The clip 28 may be formed of a plastic material which is strong and resilient. When the frames 12 and 13 are in the closed position, as shown in FIG. 4, the clip is engaged with the frames by spreading the legs 30 and 31 apart and engaging the lips 32 and 33 with the grooves 34 and 35, respectively. This may be accomplished by engaging the lips 32 and 33 with the ends of the grooves and sliding the clip 28 toward the center of the sides 20 and 25, or by sliding the lips 32 and 33 over the outer surfaces of the outer walls 22 and 17 respectively until they engage the grooves 34 and 35 respectively. As shown in FIG. 4, the base portion 29 may be bowed slightly toward the legs 30 and 31 and may contact the mating edges of the sides 20 and 25.

The clip 28 may also engage any other pair of mating sides in order to maintain the frames 12 and 13 in the closed position. For example, grooves 36 and 37 can be formed in the planar surfaces 17 and 22 respectively and extend substantially parallel to the sides 21 and 26, respectively. Grooves 38 and 39 can be formed in the planar surfaces 17 and 22, respectively, and extend substantially parallel to the sides 19 and 24 respectively. Grooves 40 and 41 can be formed in the surfaces 17 and 22, respectively, and can extend substantially parallel to the sides 16 and 15 respectively.

Figure 5:
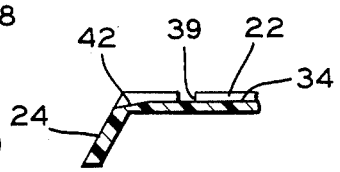
FIG. 5 is a cross-sectional view of the device shown in FIG. 2 taken along the line 5—5 and enlarged.

There is shown in FIG. 5 an enlarged cross-sectional view taken along the line 5—5 of FIG. 2. This figure illustrates the configuration of the crossing of the grooves 34 and 39 and is similar to the other seven points at which grooves cross on the frames 12 and 13. The end of each groove can be chamfered as at 42 to assist in camming the respective lip of the clip 28 into engagement with the respective groove, and thereby facilitate the application of the clip 28 into an operative position.

The clip 28 also can function as a stand for the frames 12 and 13. If the base portion 29 is placed on a horizontal surface, the frames 12 and 13 will be held in an upright position such that any articles retained between the frames can be viewed through the rectangular openings 18 and 23. Since the clip 28 can engage any pair of sides, articles such as photographs can be displayed in their proper viewing position. The interior spacing between the planar surfaces 17 and 22 can be dimensioned to firmly retain a standard number of photographs such as twelve, twenty-four, or thirty-six. Furthermore, the outer surface of the base portion 29 can be formed with a rough or matte surface suitable for receiving a written identification of the articles contained within the frames. In the alternative, the outer surface of the base portion 29 can be embossed or preprinted with identifying or advertising material.

Figure 6:
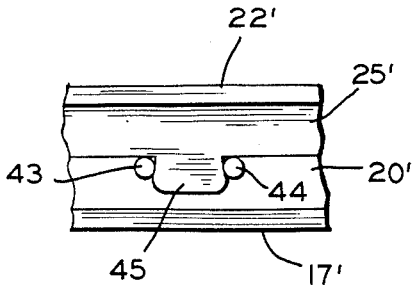
FIG. 6 is a fragmentary side elevational view of an alternate embodiment of the present invention.

There is shown in FIG. 6 an alternative means for retaining the frames 12 and 13 in the closed position. FIG. 6 is an enlarged fragmentary view of an inside portion of planar surfaces 17' and 22' which are similar to the planar surfaces 17 and 22. Connected to the planar surfaces 17' and 22' are sides 20' and 25' respectively which are similar to the sides 20 and 25 shown in FIG. 4. On the interior of the side 20' are formed a pair of spaced apart projections 43 and 44 which typically are in the form of spheres. Attached to the side 25 is a tab 45 having a width slightly greater than the minimum distance between the projections 43 and 44. The plastic material from which the projections 43 and 44 and the tab 45 are formed is flexible enough so that the tab 45 can be forced between the projections 43 and 44 and snap into engagement behind them to retain the frames 12 and 13 in the closed position.

The frames 12 and 13 can be made in various sizes to fit the standard sizes for photographs. Some of the more popular sizes are three inches by five inches, four inches by six inches and five inches by seven inches. The retainer and display device according to the present invention could be supplied with the photographs from the processor or could be sold separately. The device can be provided in various colors and surface finishes, as desired.

In accordance with the provisions of the patent statutes, the principle and mode of operation of the present invention has been explained and illustrated in its preferred embodiment. However, it must be appreciated that the present invention can be practiced otherwise than as specifically explained and illustrated without departing from its spirit or scope.

What is claimed is:

1. A device for retaining and displaying an article such as a photograph comprising:

a pair of frames each having an outer wall approximately equal in size and shape to a planar surface of an article to be retained and displayed and each frame having a plurality of side walls extending inwardly from a periphery of the outer wall, an outer surface of each of the outer walls having a groove formed therein, at least one end of each of the grooves extending to one of the side walls and having a chamfer formed therein;

hinge means connected between one of the side walls of each of said frames; and clip means for releasably engaging the outer walls of said frames to retain an edge of at least one of the side walls of one of said frames in contact with an edge of at least of one of the side walls of the other of said frames, said clip means including a pair of legs attached to opposite edges of a base portion at one end, each of said legs having another end for engaging at least one of the grooves formed in the outer wall of one of said frames whereby the leg is cammed into the groove as said clip means engages the outer walls of said frame to thereby retain an article between the outer walls of said frames.

* * * * *